US006688856B1

(12) United States Patent
Motegi et al.

(10) Patent No.: US 6,688,856 B1
(45) Date of Patent: Feb. 10, 2004

(54) SUCTION MUFFLER FOR A HERMETIC COMPRESSOR

(75) Inventors: Manabu Motegi, Kanagawa (JP); Masahiko Osaka, Kanagawa (JP); Akihiko Kubota, Kanagawa (JP); Masahiro Kakutani, Kanagawa (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 09/959,868

(22) PCT Filed: May 16, 2000

(86) PCT No.: PCT/JP00/03124

§ 371 (c)(1),
(2), (4) Date: Feb. 4, 2002

(87) PCT Pub. No.: WO00/73656

PCT Pub. Date: Dec. 7, 2000

(30) Foreign Application Priority Data

May 27, 1999 (JP) ..... 11-147955

(51) Int. Cl.[7] ..... F04B 39/00

(52) U.S. Cl. ..... 417/312; 417/363; 62/296; 181/229

(58) Field of Search ..... 417/363, 312, 417/902; 181/403, 229; 62/296

(56) References Cited

U.S. PATENT DOCUMENTS 4,531,894 A * 7/1985 Kawai et al. ..... 417/312
4,573,880 A * 3/1986 Hirano et al. ..... 417/312
4,759,693 A * 7/1988 Outzen ..... 417/312
5,201,640 A 4/1993 Heinzelmann et al.
5,341,654 A 8/1994 Hewette et al.
5,588,810 A * 12/1996 DiFlora et al. ..... 417/312
5,749,714 A * 5/1998 Lee ..... 417/312
6,358,019 B1 * 3/2002 Iversen et al. ..... 417/312
6,394,226 B1 * 5/2002 Cavicchioli ..... 181/229

FOREIGN PATENT DOCUMENTS

EP 0 073 469 3/1983 ..... 417/312
EP 0 902 184 3/1999 ..... 417/312
JP 59-43917 3/1984

* cited by examiner

*Primary Examiner*—Cheryl J. Tyler
(74) *Attorney, Agent, or Firm*—Wenderoth, Lind & Ponack, L.L.P.

(57) ABSTRACT

A closed motor-driven compressor includes a compression component (2) and an electric component (3) for driving the compression component (2), both of which are elastically supported within a closed vessel (1). A suction muffler (8) is mounted on the compression component (2) and includes a plurality of elements (10, 11, 12; 14, 15, 16; 18, 19, 20; 22, 23, 24; 26, 27, 28) assembled together and each made of synthetic resin. One of the plurality of elements (10, 11, 12; 14, 15, 16; 18, 19, 20; 22, 23, 24; 26, 27, 28) has a guide rib (13; 17; 21) integrally formed therewith that is tapered down toward an adjoining one of the plurality of elements (10, 11, 12; 14, 15, 16; 18, 19, 20; 22, 23, 24; 26, 27, 28), thereby facilitating assembly of the two elements.

4 Claims, 11 Drawing Sheets

Fig. 3
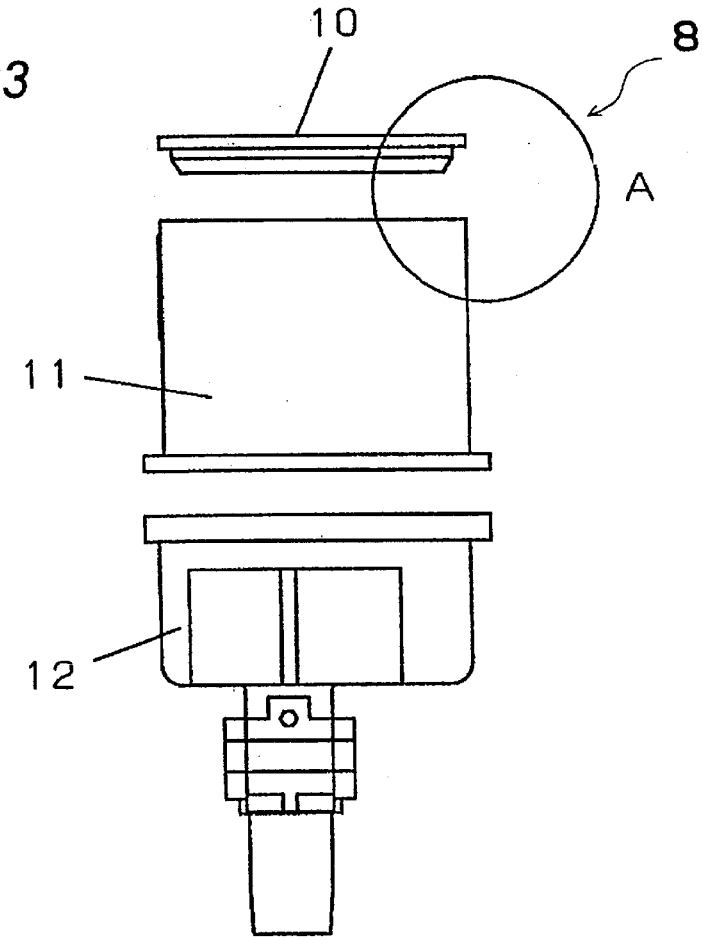
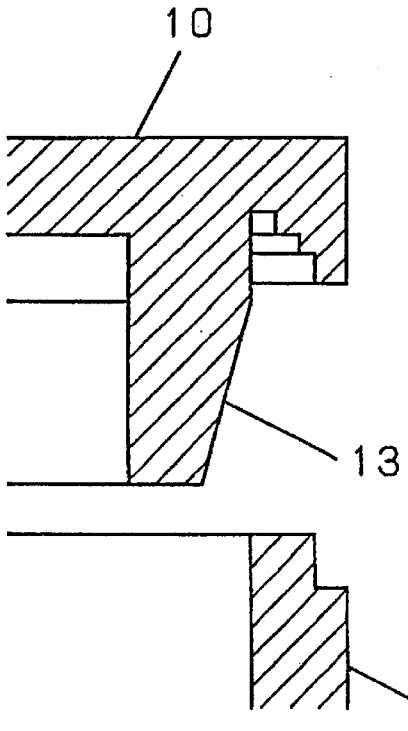
Fig. 4

*Fig. 11* - PRIOR ART

*Fig. 12* - PRIOR ART

Fig. 13
PRIOR ART
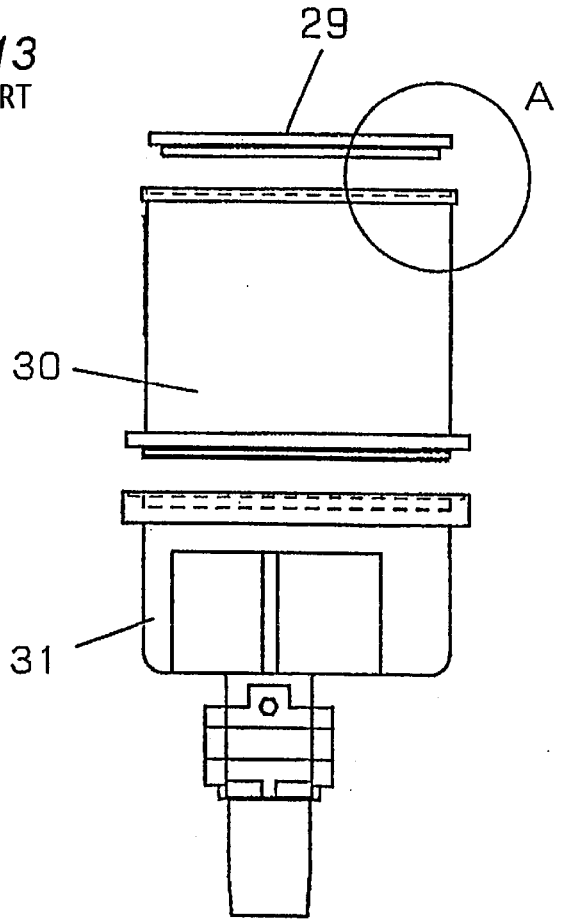
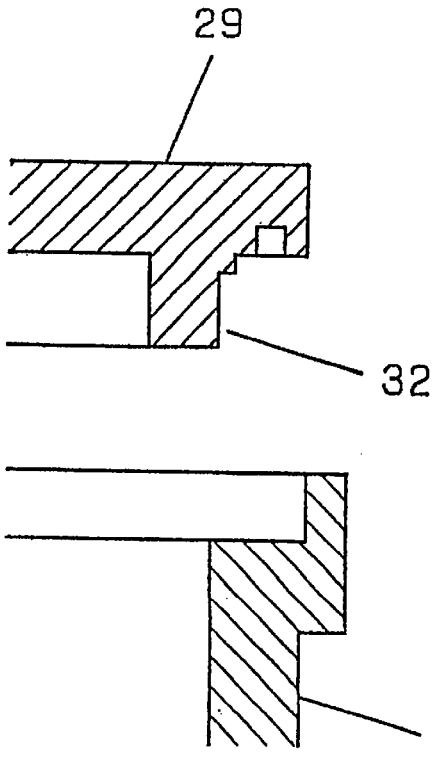
Fig. 14
PRIOR ART

SUCTION MUFFLER FOR A HERMETIC COMPRESSOR

TECHNICAL FIELD

The present invention relates to a closed motor-driven compressor for use in refrigerators, air conditioners or the like.

BACKGROUND ART

Recently, closed motor-driven compressors are demanded to have a high energy efficiency, and it is well known that a suction muffler having a low thermal conductivity and made of, for example, synthetic resin is suited for use in such compressors.

Japanese Laid-Open Patent Publication (unexamined) No. 10-47248 discloses a closed motor-driven compressor as shown in FIGS. 11 and 12. This compressor includes a compression component 2 and an electric component 3, both elastically supported within a closed vessel 1. The compression component 2 includes a cylinder 4, a piston 5 reciprocatingly accommodated in the cylinder 4, a valve plate 6 mounted on the cylinder 4 so as to cover an opening defined therein, and a cylinder head 7 secured to the cylinder 4. A suction muffler 8' made of synthetic resin and made up of three elements is mounted on the cylinder head 7 for introducing a refrigerant gas into the cylinder 4. The suction muffler 8' is connected to a suction pipe 9 extending through a side wall of the closed vessel 1 to introduce the refrigerant gas into the closed vessel 1.

As shown in FIG. 13, the muffler 8' includes a first element 29, a second element 30 to which the first element 29 is secured, and a third element 31 secured to the second element 30. As shown in FIG. 14, the first element 29 has an inwardly protruding guide rib 32 integrally formed therewith. The guide rib 32 acts to facilitate the assembling of the first and second elements 29, 30. After the first and second elements 29, 30 have been assembled using the guide rib 32, they are assembled with the third element 31, and all of them are joined together by ultrasonic welding.

In the closed motor-driven compressor of the above-described construction, the refrigerant gas from the low-pressure side in a refrigerating cycle is introduced into the closed vessel 1 through the suction pipe 9 and then into the cylinder 4 through the suction muffler 8' before the refrigerant gas is compressed by the piston 5.

In the above-described construction, however, because the suction muffler 8' is made of synthetic resin, it is apt to be deformed after injection molding. Accordingly, a difficulty is encountered in assembling the first and second elements 29, 30 with the use of the guide rib 32.

U.S. Pat. No. 5,341,654 discloses a refrigeration compressor, wherein V-shaped ribs extend laterally across respective flange portions as well as a tubular member adjacent the opposite ends of the flange portions of a muffler, which is fabricated from a polymeric composition.

The present invention has been developed to overcome the above-described disadvantages.

It is accordingly an objective of the present invention to provide a closed motor-driven compressor having an improved suction muffler that facilitates the assembly of its elements.

DISCLOSURE OF THE INVENTION

In accomplishing the above and other objectives, the closed motor-driven compressor according to the present invention includes a closed vessel, a compression component elastically supported within the closed vessel, an electric component elastically supported within the closed vessel for driving the compression component, and a suction muffler mounted on the compression component and including a plurality of elements assembled together and each made of synthetic resin. One (first element) of the plurality of elements has a guide rib integrally formed therewith that is tapered down toward an adjoining one (second element) of the plurality of elements. The tapered guide rib acts to reform deformation of the second element into which it is inserted, thus facilitating an assembly of the first and second elements.

The guide rib is formed discontinuously or intermittently along a peripheral edge of the first element. By so doing, strains caused by the cooling of the first element after injection molding are relatively small, thus reducing deformation of the first element.

The first element may have first and second peripheral portions and third and fourth peripheral portions each interposed between the first and second peripheral portions, wherein the first and second peripheral portions have first and second radii of curvature, respectively, while the third and fourth peripheral portions have third and fourth radii of curvature, respectively, that are smaller than the first and second radii of curvature, and wherein the guide rib is formed at the third or fourth peripheral portion and at the first and second peripheral portions adjacent thereto.

In assembling the first and second elements, the first and second portions of the second element having large radii of curvature are subjected to relatively small deformation, while the third and fourth portions of the second element having small radii of curvature are subjected to larger deformation. Accordingly, the guide rib formed at the first and second peripheral portions of the first element can be readily inserted into the corresponding portions of the second element, and the guide rib gradually reforms the deformation of the second element. Such insertion facilitates subsequent insertion of the guide rib into the third and fourth portions of the second element, making it possible to realize automated assembling of suction mufflers.

The plurality of elements are secured to one another by welding. The welding reduces a leakage of suction gas from the suction muffler.

Alternatively, the plurality of elements are secured to one another by fastening means such, for example, as rivets, screws, or the like. The use of such fastening means requires no expensive welding machine or the like.

Again alternatively, the plurality of elements are secured to one another by introducing projections formed therewith into openings defined therein. The assembling of the elements by engagement of the projections with the openings requires no fastening means referred to above.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein:

FIG. 3 is an exploded view of a suction muffler mounted in the closed motor-driven compressor of FIG. 1;

FIG. 4 is an enlarged cross-sectional view of a portion A in FIG. 3;

FIG. 13 is an exploded view of a suction muffler mounted in the closed motor-driven compressor of FIG. 11; and FIG. 14 is an enlarged cross-sectional view of a portion A in FIG. 13.

DETAILED DESCRIPTION OF THE PREFERRED EMBODIMENTS

This application is based on application No. 11-147955 filed May 27, 1999 in Japan, the content of which is incorporated hereinto by reference.

Figure 1:
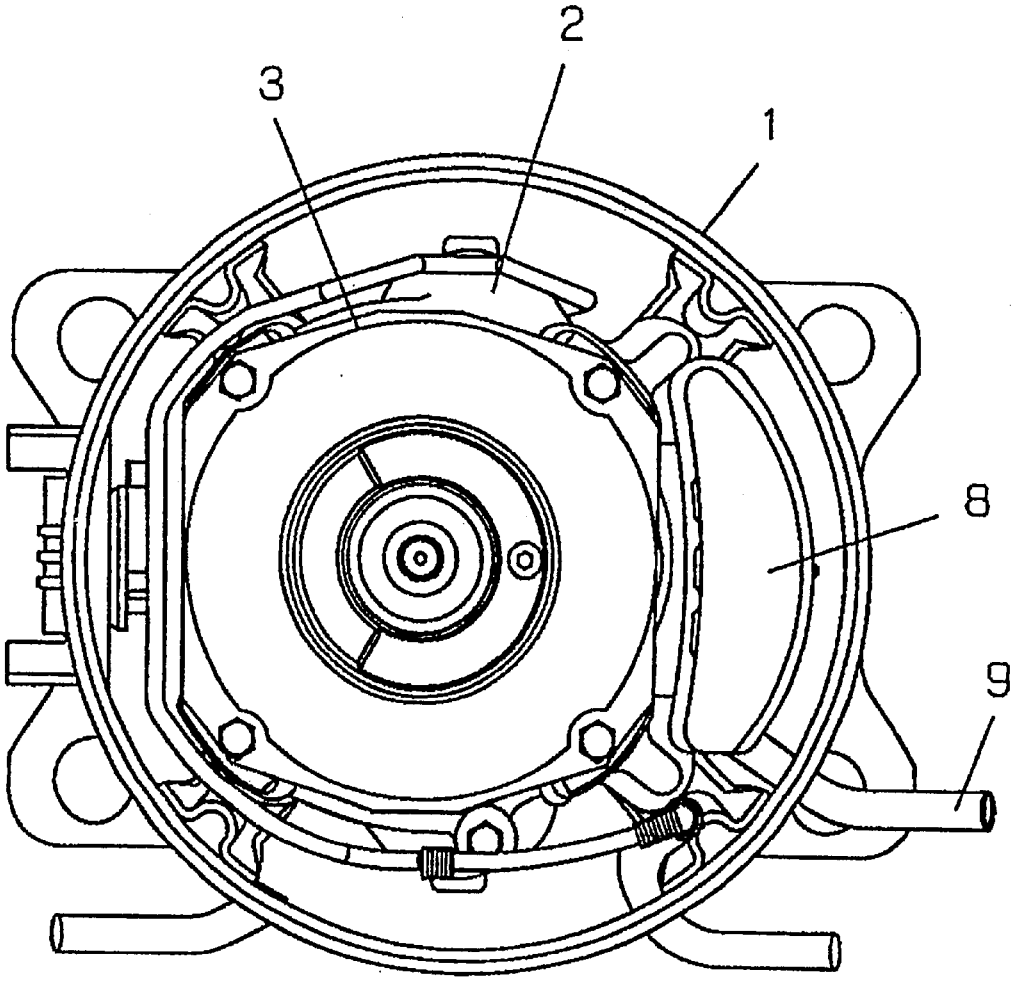
FIG. 1 is a top plan view of a closed motor-driven compressor according to the present invention with a closed vessel partially removed.
Figure 2:
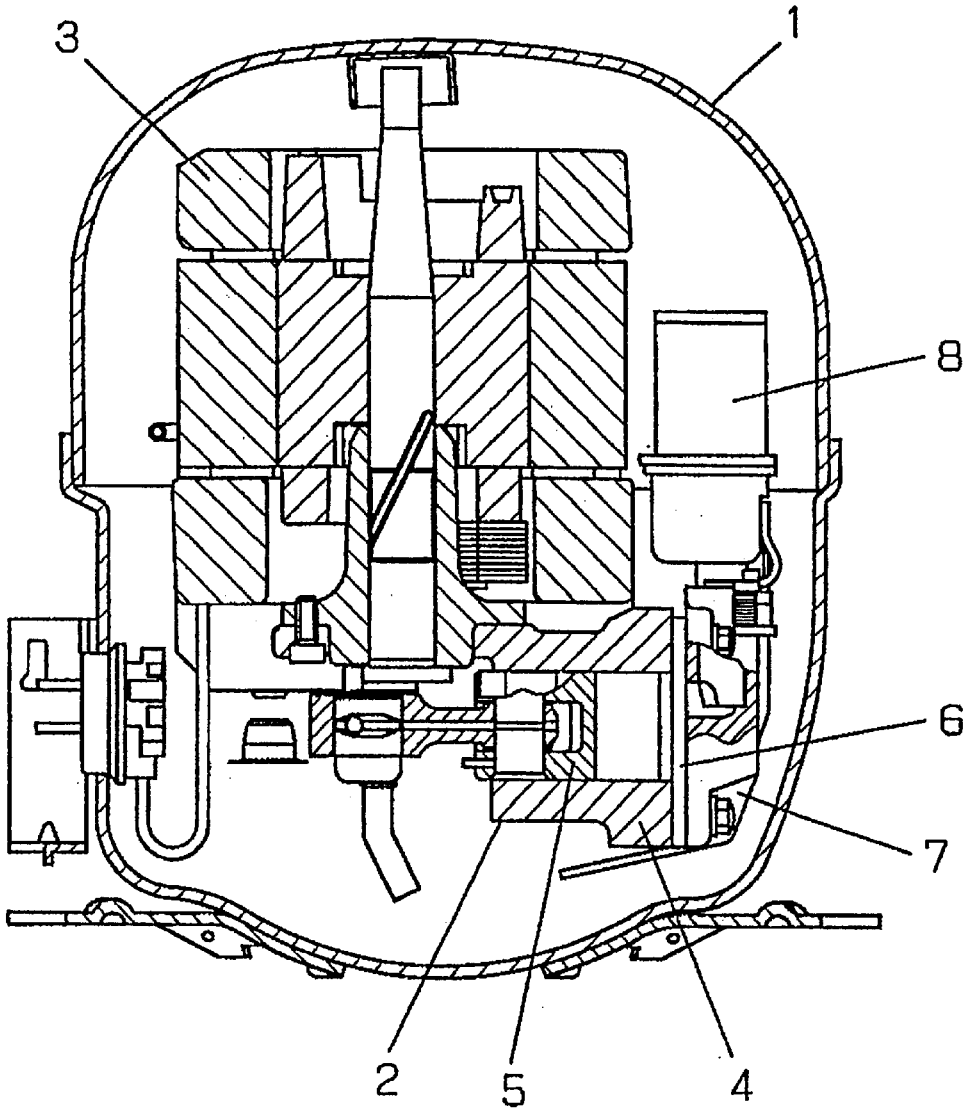
FIG. 2 is a vertical sectional view of the closed motor-driven compressor of FIG. 1.

Referring now to the drawings, there is shown in FIGS. 1 and 2 a closed motor-driven compressor embodying the present invention. The compressor shown therein includes a compression component 2 and an electric component 3 for driving the compression component 2, both of which are elastically supported within a closed vessel 1. The compression component 2 includes a cylinder 4, a piston 5 reciprocatingly accommodated in the cylinder 4, a valve plate 6 mounted on the cylinder 4 so as to cover an opening defined therein, and a cylinder head 7 secured to the cylinder 4. A suction muffler 8 is mounted on the cylinder head 7 for introducing a refrigerant gas into the cylinder 4. The suction muffler 8 is made of synthetic resin and includes three elements assembled together. The suction muffler 8 is connected to a suction pipe 9 extending through a side wall of the closed vessel 1 to introduce the refrigerant gas into the closed vessel 1.

As shown in FIG. 3, the suction muffler 8 includes a first element 10, a second element 11 to which the first element 10 is secured, for example, by welding, and a third element 12 secured to the second element 11, for example, by welding. The welding reduces a leakage of suction gas from the suction muffler 8. Each of the first to third elements 10, 11, 12 is injection-molded from polybutylene terephthalate (PBT).

As shown in FIG. 4, the first element 10 has an inwardly or downwardly protruding guide rib 13 integrally formed therewith. The guide rib 13 is formed continuously along the peripheral edge of the first element 10 and is tapered down inwardly or downwardly. More specifically, the inner surface of the guide rib 13 extends substantially straight in the vertical direction, while the outer surface of the guide rib 13 is inclined such that the thickness of the guide rib 13 gradually decreases inwardly or downwardly.

By the above-described construction, in assembling the first and second elements 10, 11, the guide rib 13 of the first element 10 reforms deformation of the second element 11. Accordingly, the first and second elements 10, 11 can be assembled together merely by inserting the guide rib 13 into an associated end portion of the second element 11, thus facilitating the assembling work.

Figure 5:
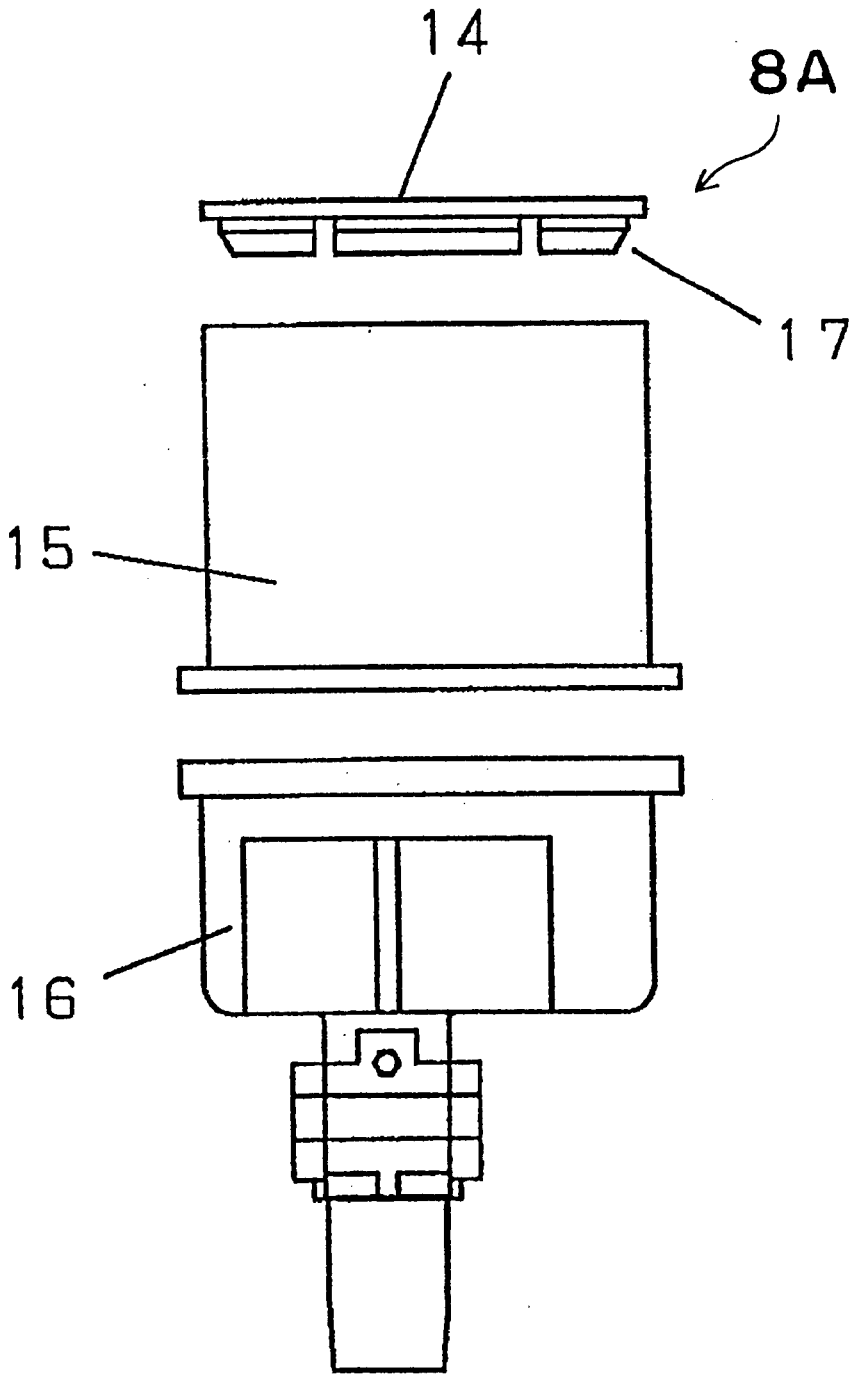
FIG. 5 is a view similar to FIG. 3, but depicting a modification thereof.

FIG. 5 depicts a modification 8A of the suction muffler 8 shown in FIG. 3.

This suction muffler 8A includes first to third elements 14, 15, 16 assembled together, just like the suction muffler 8. The suction muffler 8A, however, differs from the suction muffler 8 in that the first element 14 has an inwardly or downwardly protruding guide rib 17 that is formed discontinuously along the peripheral edge of the first element 14.

Because the tapered guide rib 17 is formed intermittently along the peripheral edge of the first element 14, strains caused by the cooling of the first element 14 after the injection molding are relatively small, thus reducing deformation of the first element 14.

Figure 6:
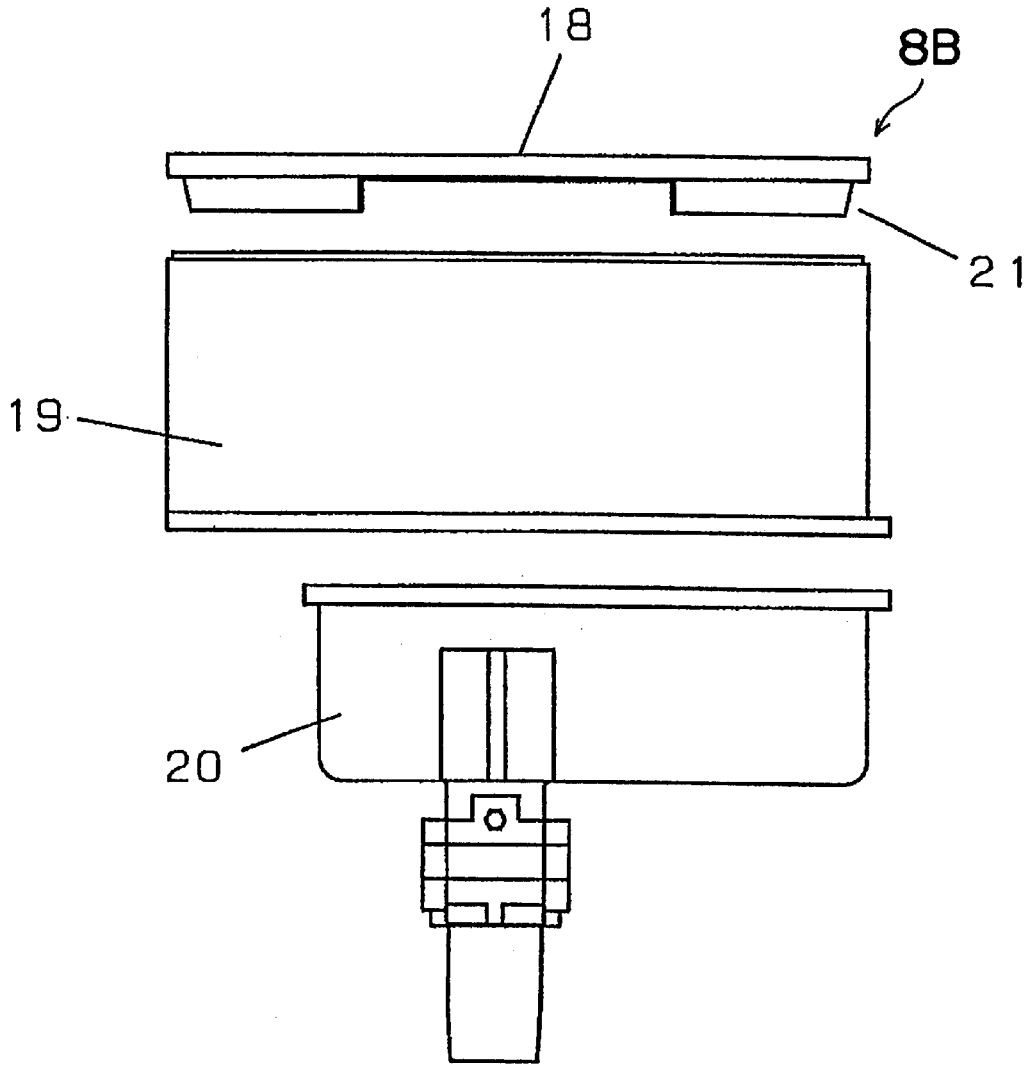
FIG. 6 is a view similar to FIG. 3, but depicting another modification thereof.

FIG. 6 depicts another modification 8B of the suction muffler 8, and as shown therein, the suction muffler 8B includes first to third elements 18, 19, 20 assembled together.

The second element 19 has a generally crescent-shaped open end portion (upper end portion in this case), which has first and second portions opposite to each other and third and fourth portions opposite to each other and each interposed between the first and second portions. The first and second portions have respective relatively large radii of curvature, while the third and fourth portions have respective relatively small radii of curvature.

Figure 7:
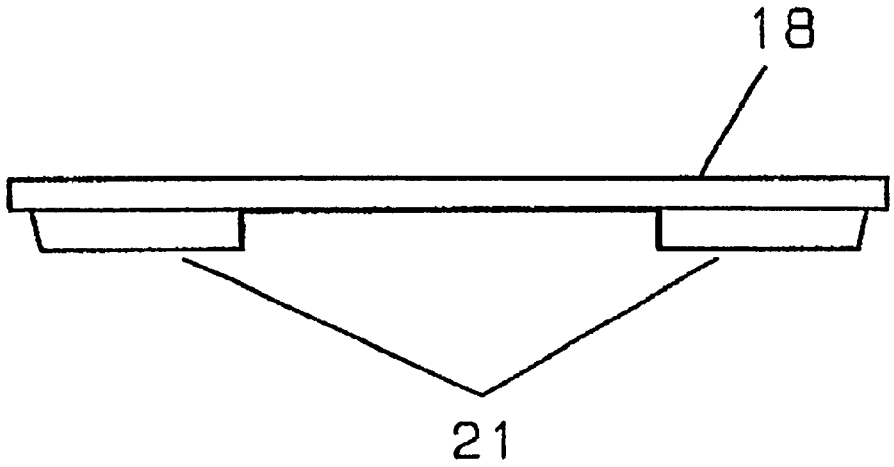
FIG. 7 is a front view of one of a plurality of elements constituting the suction muffler of FIG. 6.
Figure 8:
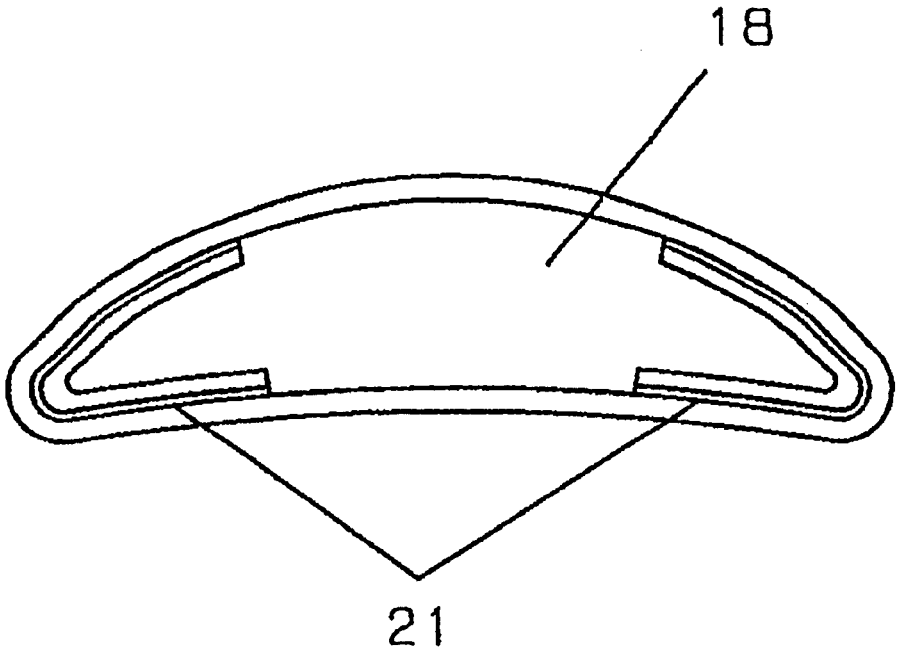
FIG. 8 is a bottom plan view of the element of FIG. 7.

As shown in FIGS. 7 and 8, the first element 18 has a shape corresponding to that of the generally crescent-shaped open end portion of the second element 19 and, hence, has first and second peripheral portions having respective large radii of curvature and third and fourth peripheral portions having respective small radii of curvature and each interposed between the first and second peripheral portions. The first element 18 also has inwardly or downwardly protruding tapered guide ribs 21 each integrally formed therewith at the third or fourth peripheral portion and at the first and second peripheral portions adjacent thereto.

In assembling the first and second elements 18, 19, the first and second portions of the second element 19 having the large radii of curvature are subjected to relatively small deformation, while the third and fourth portions of the second element 19 having the small radii of curvature are subjected to larger deformation. Accordingly, the guide ribs 21 formed at the first and second peripheral portions of the first element 18 can be readily inserted into the corresponding portions of the second element 19, and the former gradually reform the deformation of the second element 19. Such insertion facilitates subsequent insertion of the guide ribs 21 into the third and fourth portions of the second element 19, making it possible to realize automated assembling of suction mufflers.

As is the case with the suction muffler 8A shown in FIG. 5, the first element 18 has separated or discontinuous guide ribs 21 and, hence, strains caused by the cooling of the first element 18 after the injection molding are relatively small, thus reducing deformation of the first element 18.

Figure 9:
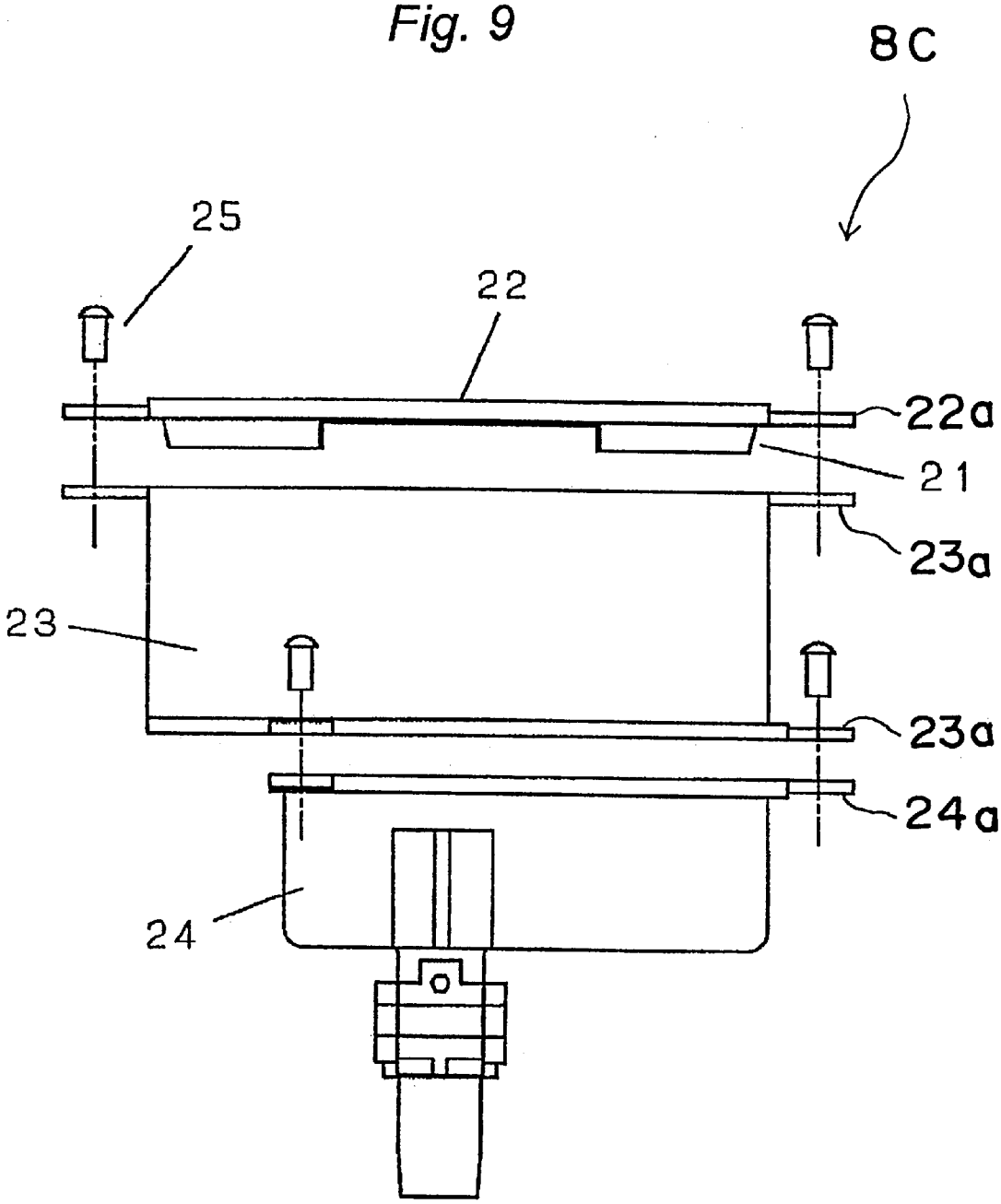
FIG. 9 is a view similar to FIG. 3, but depicting a further modification thereof.

As shown in FIG. 9 depicting a further modification 8C of the suction muffler, first to third elements 22, 23, 24 may have respective tabs 22*a*, 23*a*, 24*a* integrally formed therewith and extending laterally outwardly therefrom so that the three elements 22, 23, 24 may be assembled together by means of rivets 25. The assembling of the elements 22, 23, 24 by the rivets 25 requires no expensive welding machine or the like. Screws may be used in place of the rivets 25.

Figure 10:
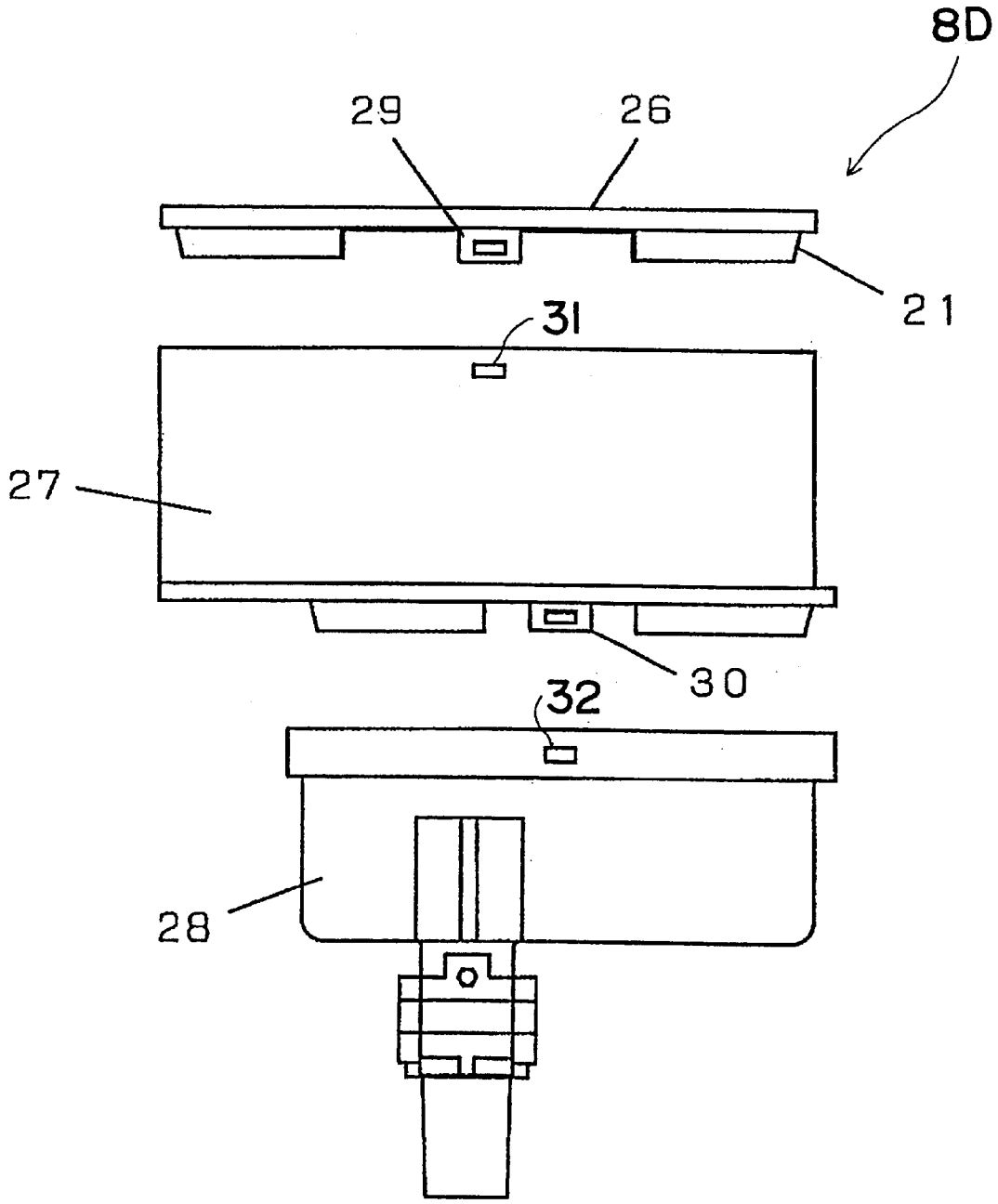
FIG. 10 is a view similar to FIG. 3, but depicting a still further modification thereof.
Figure 11:
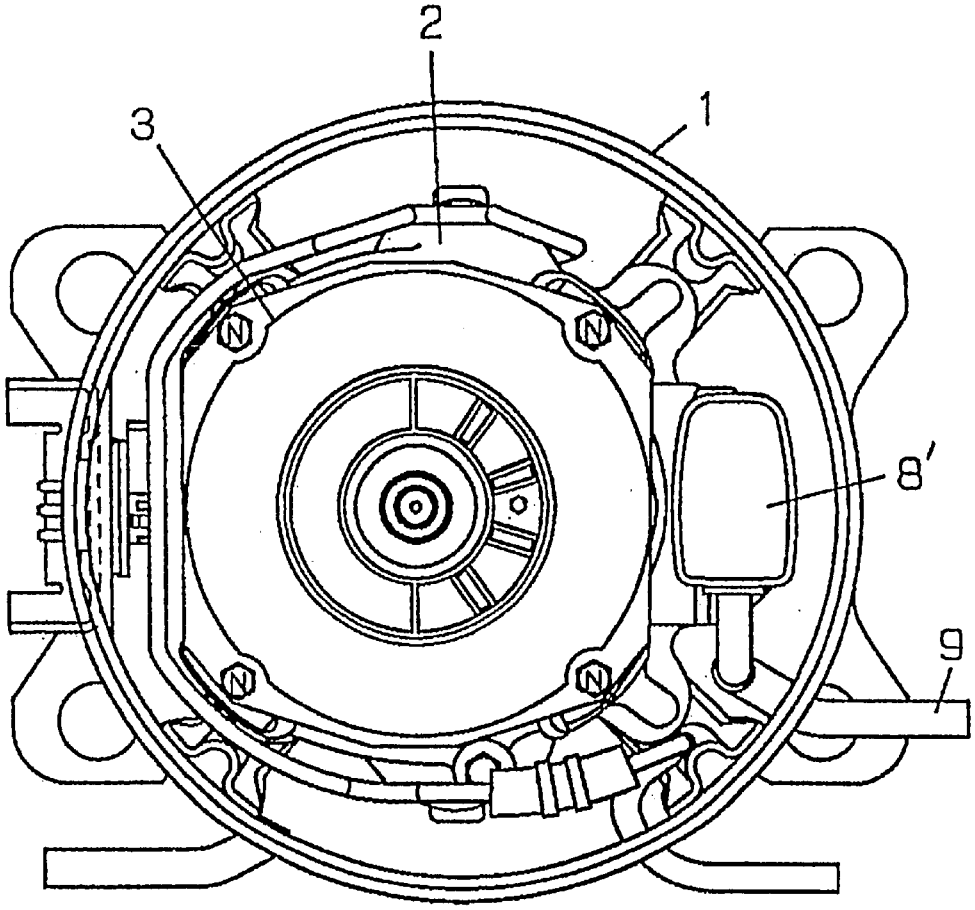
FIG. 11 is a top plan view of a conventional closed motor-driven compressor with a closed vessel partially removed.
Figure 12:
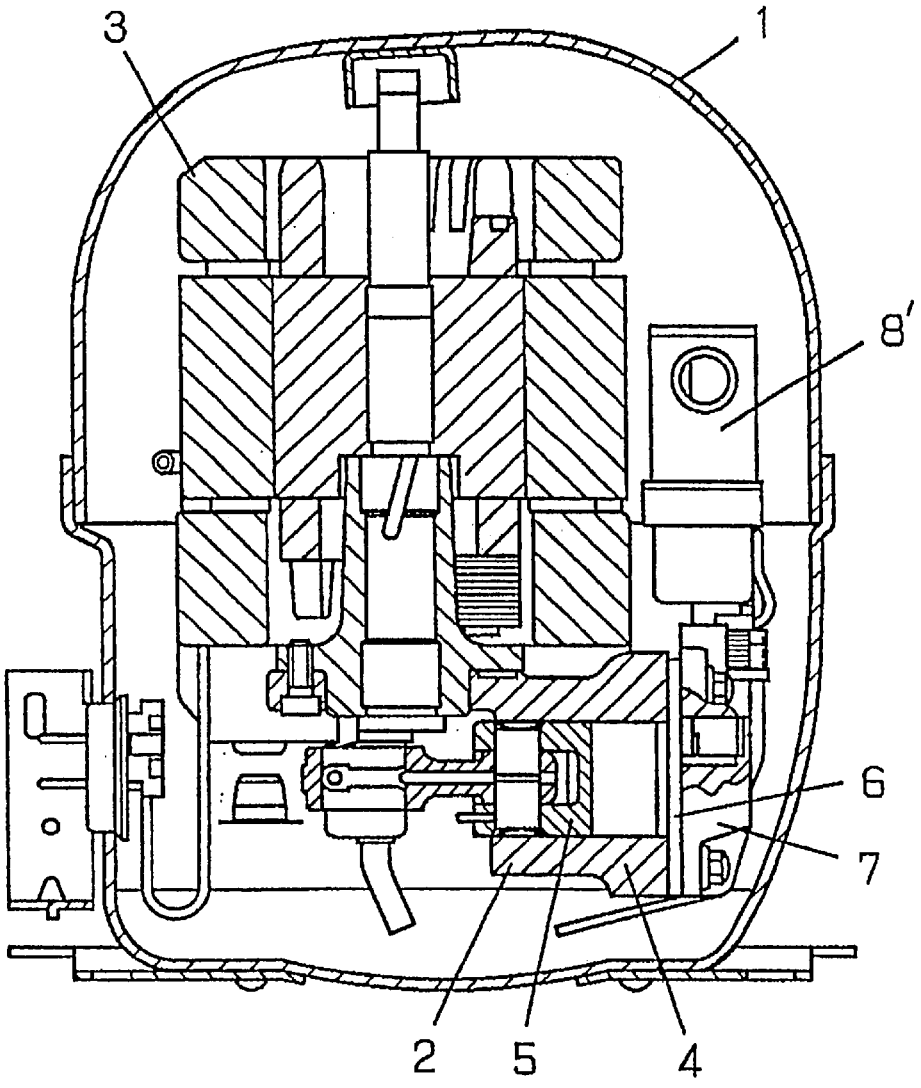
FIG. 12 is a vertical sectional view of the closed motor-driven compressor of FIG. 11.

Alternatively, as shown in FIG. 10 depicting a still further modification 8D of the suction muffler, first to third elements 26, 27, 28 may have respective tabs and/or projections integrally formed therewith. In the case of FIG. 10, the first element 26 has downwardly extending tabs 29 each having an opening defined therein, while the second element 27 has projections 31 each formed at an upper portion thereof. Likewise, the second element 27 has downwardly extending tabs 30 each having an opening defined therein, while the third element 28 has projections 32 each formed at an upper portion thereof.

In assembling the three elements 26, 27, 28, each of the projections 31 of the second element 27 is introduced into and received in the opening of the associated tab 29 of the first element 26, while each of the projections 32 of the third element 28 is introduced into and received in the opening of the associated tab 30 of the second element 27. The assembling of the elements 26, 27, 28 by the engagement of the projections 31, 32 with the tabs 29, 30 requires no additional fastening means such, for example, as screws, rivets, or the like.

What is claimed is:

1. A closed motor-driven compressor comprising:

a closed vessel;

a compression component elastically supported within the closed vessel;

an electric component elastically supported within the closed vessel for driving the compression component; and a suction muffler mounted on the compression component and comprising a plurality of elements assembled together and each made of synthetic resin, one first of the plurality of elements having a guide rib integrally formed therewith that is tapered down toward an adjoining one second of the plurality of elements, thereby facilitating assembly of the two elements, wherein the guide rib is formed discontinuously alone a peripheral edge of the first element, and wherein the one first element has first and second peripheral portions and third and fourth peripheral portions each interposed between the first and second peripheral portions, the first and second peripheral portions having first and second radii of curvature, respectively, the third and fourth peripheral portions having third and fourth radii of curvature, respectively, that are smaller than the first and second radii of curvature, and wherein the guide rib is formed at the third or fourth peripheral portion and at the first and second peripheral portions adjacent thereto.

2. The closed motor-driven compressor according to claim 1, wherein the plurality of elements are secured to one another by welding.

3. The closed motor-driven compressor according to claim 1, wherein the plurality of elements are secured to one another by fastening elements.

4. The closed motor-driven compressor according to claim 1, wherein the plurality of elements are secured to one another by introducing projections formed therewith into openings defined therein.

* * * * *